United States Patent [19]

Gauld

[11] 4,043,901

[45] Aug. 23, 1977

[54] WOOD CHIP SCREENS

[75] Inventor: Warren Thomas Gauld, Mobile, Ala.

[73] Assignee: Gauld Equipment Sales Company, Mobile, Ala.

[21] Appl. No.: 637,303

[22] Filed: Dec. 3, 1975

[51] Int. Cl.[2] ..... B07B 1/24

[52] U.S. Cl. ..... 209/10; 209/25; 209/86; 209/294; 209/295

[58] Field of Search ..... 209/21, 24, 28, 86, 209/284, 288, 293, 294, 295, 296, 297, 298, 299, 10, 25

[56] References Cited

U.S. PATENT DOCUMENTS

| | | | |
|---|---|---|---|
| 324,595 | 8/1885 | Saint Requier | 209/284 |
| 1,099,420 | 6/1914 | Bryan et al. | 209/295 |
| 1,668,629 | 5/1928 | Church | 209/297 |
| 2,143,497 | 1/1939 | Rahmberg | 209/295 X |
| 2,785,798 | 3/1957 | Walker | 209/295 X |
| 3,545,609 | 12/1970 | Carrera et al. | 209/10 |
| 4,000,061 | 12/1976 | Bowling et al. | 209/21 |

FOREIGN PATENT DOCUMENTS

| | | | |
|---|---|---|---|
| 732,750 | 9/1932 | France | 209/295 |
| 2,101,711 | 7/1972 | Germany | 209/295 |

*Primary Examiner*—Robert B. Reeves
*Assistant Examiner*—Joseph J. Rolla
*Attorney, Agent, or Firm*—Larson, Taylor and Hinds

[57] ABSTRACT

A drum screen for cleaning and classifying wood chips is mounted for rotation. The screen has apertures of varying size to permit cleaned chips to pass through to be deposited on conveyors located below. An internal annular spiral baffle extends the full length of the drum and a series of chip lifters are located between the flights of the spiral baffle and project radially inwards from the interior surface of the drum. Wood chips are fed into the drum at one end and are carried through the drum while being lifted towards the axis of the drum by the chip lifters to effect loosening of waste material from the chips. Cleaned chips pass through the apertures in the drum and chips too large to pass through are carried forward and discharged from the end of the drum onto a conveyor. A casing surrounds the upper portion of the drum and partially encloses the discharge end of the drum. An air suction device is connected to the discharge end of the drum, drawing off all waste material loosened from the chips.

10 Claims, 5 Drawing Figures

WOOD CHIP SCREENS

This invention relates to the cleaning of wood chips preparatory to the further processing of the wood chips for use in paper making, and is particularly applicable in the cleaning of Forest Residual Chips which include a large proportion of slivers, loose bark, leaves and/or needles, sand, etc.

Rotary chip screens have been used where the axis of the screen is tilted at an angle to the horizontal to permit progressive movement of the chips through the screen from the inlet end to the discharge end, and such are provided with sections having progressively larger round perforations or slits to allow first, the discharge of waste material such as slivers, bark, sawdust, etc. and second, the discharge of usable chips. In such machines, the first or upper section of the screen has ⅛inch –¼inch holes punched as close together to allow sawdust to pass through and out of the screen. The last or lower section of the screen is perforated with 2 inch × 1 inch slots to allow the chips to pass through to a hopper below, while larger chips and slivers which do not pass through the slots leave the screen at its lower end where they are conveyed to a chip crusher or rechipper.

The present invention consists essentially of a chip screen of the perforated drum type mounted on trunnions for rotation at a relatively low speed. The interior of the drum is provided with a spiral baffle extending from the chip entry end of the drum to the discharge end of the drum. Between the flight of the spiral baffle, there is provided a series of lifters projecting radially inwards from the inner surface of the drum. A casing surrounds the upper half and a portion of the lower half of the drum and also partially encloses the discharge end of the drum. A chip feeder chute, located at the inlet end of the drum, directs the wood chips into the interior of the drum, and a chute at the discharge end of the drum directs oversize chips onto a conveyor. The inlet half of the drum is perforated to permit fines material to pass through and onto a conveyor located below the drum, while the discharge half of the drum is provided with larger perforations or slits through which acceptable chips pass to a conveyor, also located below the drum. An exhaust fan and cyclone are connected to the upper portion of the end wall of the casing whereby the small fines and small portions of bark, which are lighter than the acceptable chips, are picked up in the interior of the drum by the exhaust air current and carried off for use in the boiler room of the paper mill.

The primary object of the invention is to provide a wood chip screen in which all unwanted material and dirt is removed from the wood chips and is withdrawn from the rotating screen by suction, while the fine and acceptable chips are passed through the perforations of the screen.

A further object of the invention is to separate the fine chips from the acceptable chips, and at the same time discharge the oversize chips from the end of the screen.

A further object of the invention is to create sufficient turbulence within the chip screen which will accelerate the separation of the fine, the acceptable and the oversize chips within a relatively short length screen.

A further object of the invention is to provide means whereby waste material, separated from usable material by turbulence within the screen, can be readily withdrawn from the screen by means of air suction.

These and other objects of the invention will be apparent from the following detailed specification and the accompanying drawings in which.

Figure 1:
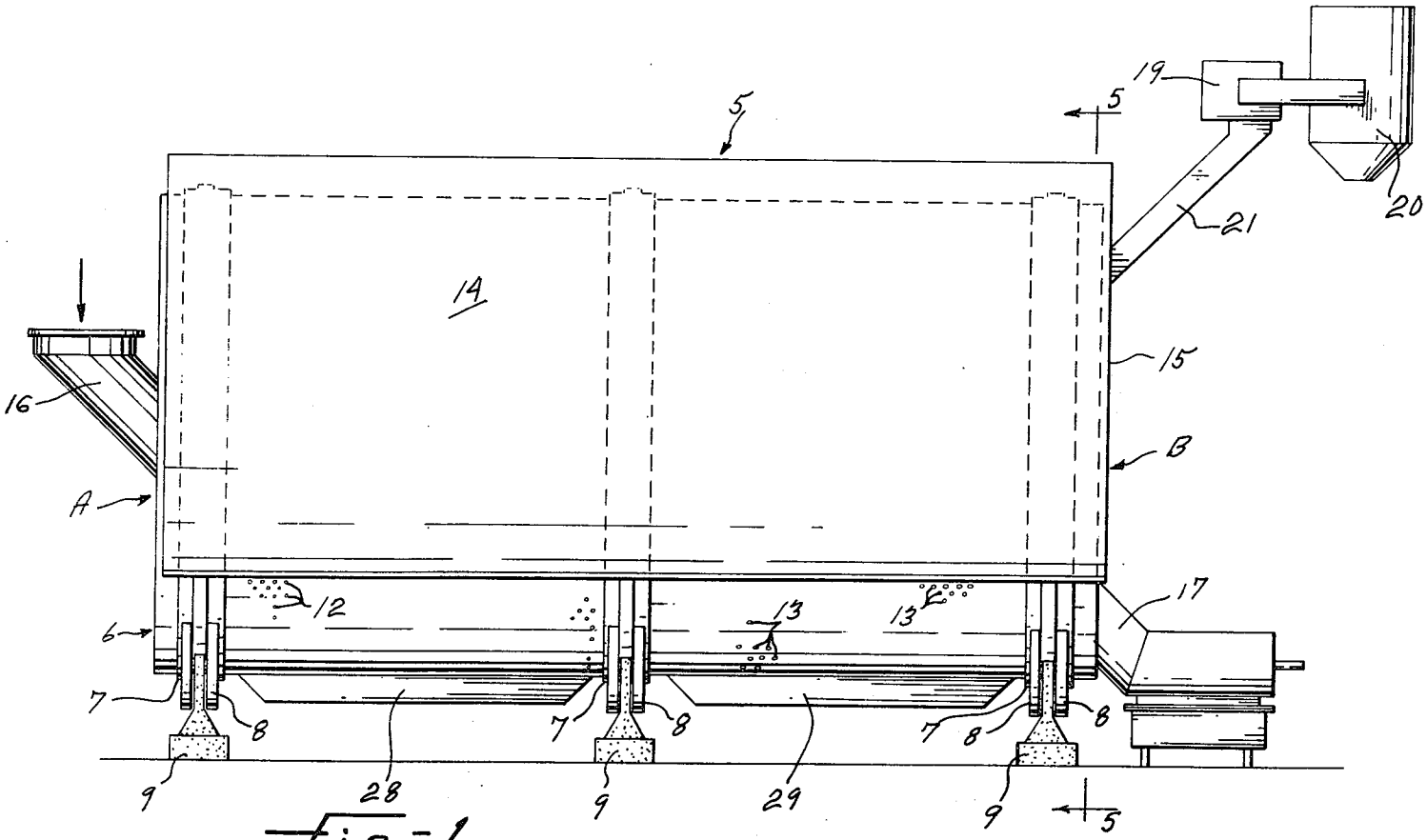
FIG. 1 is a side elevation of a chip screen according to the present invention.
Figure 2:
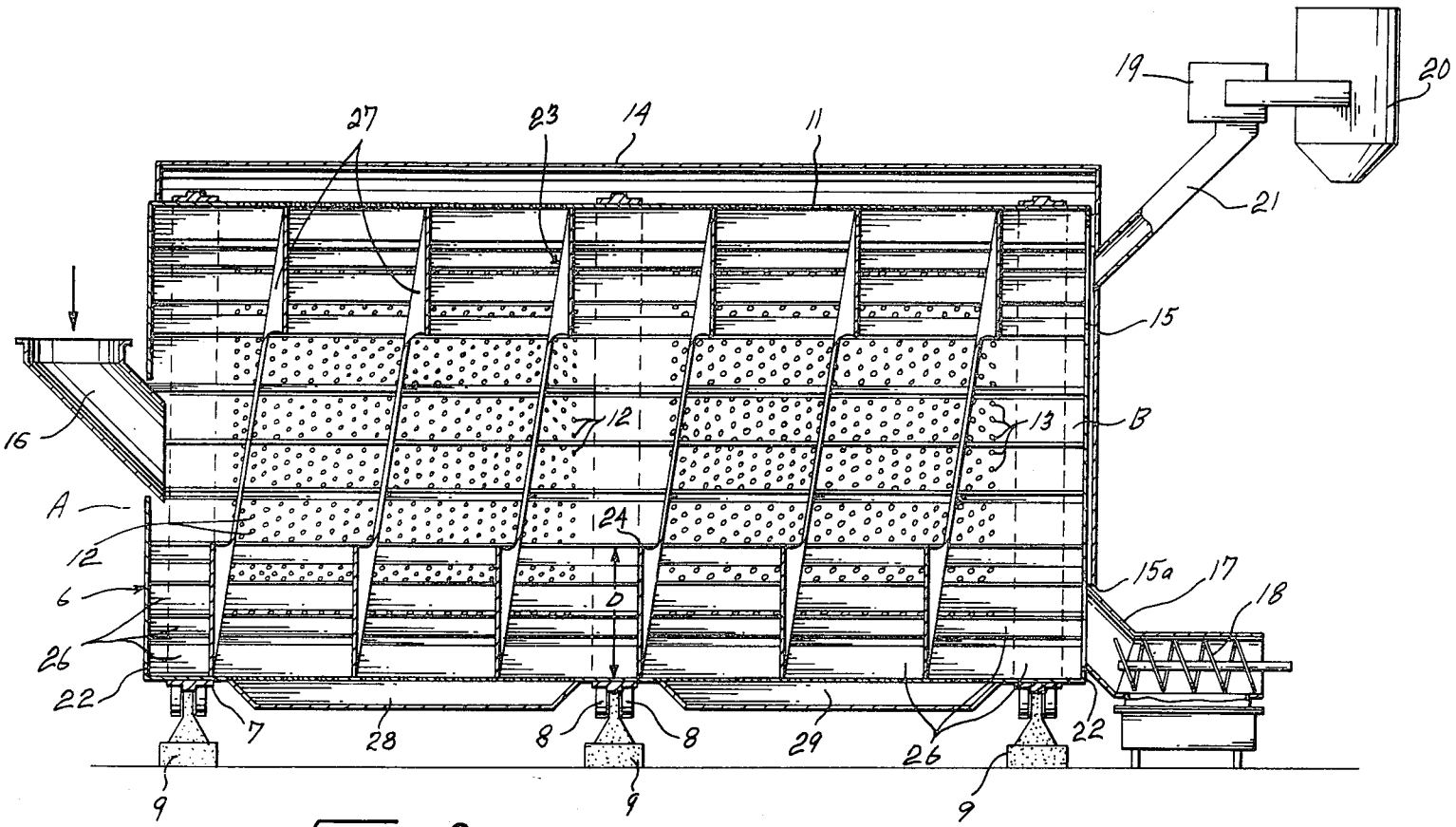
FIG. 2 is a vertical longitudinal section of the chip screen shown in FIG. 1.
Figure 4:
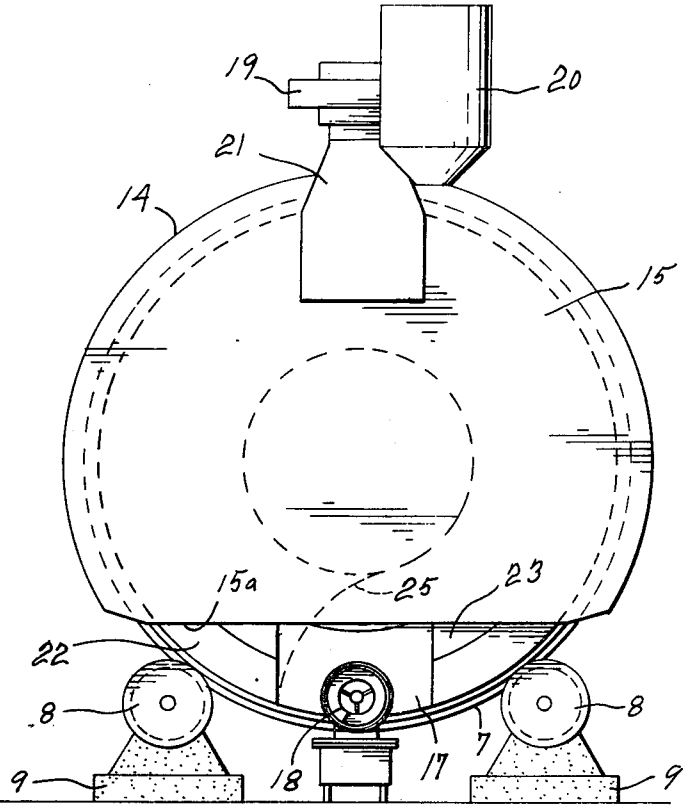
FIG. 4 is a view looking on the discharge end of the chip screen.
Figure 3:
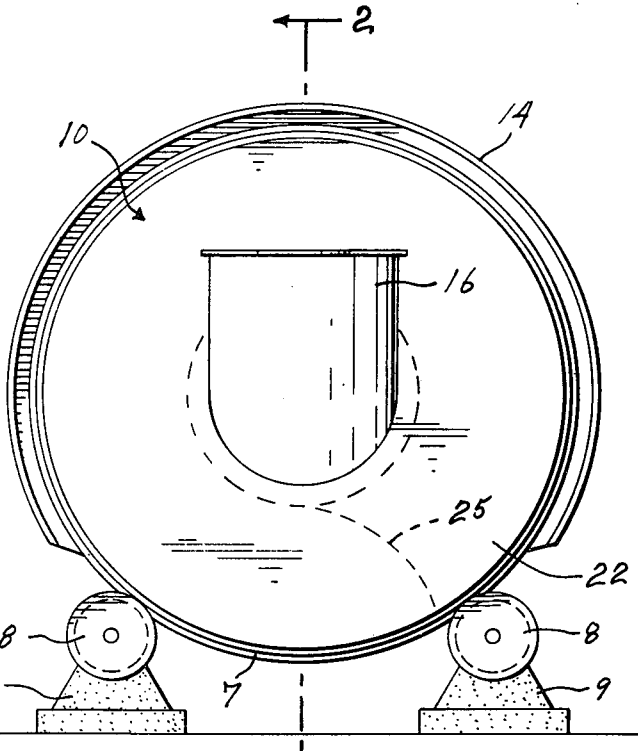
FIG. 3 is a view looking on the inlet end of the chip screen.
Figure 5:
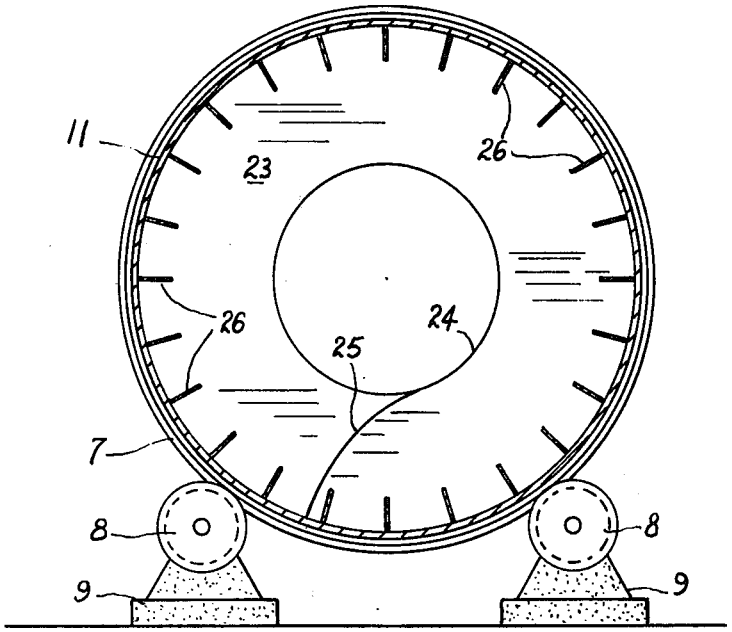
FIG. 5 is a vertical sectional view of the discharge end of the chip screen, taken on the line 5—5 of FIG. 1.

Referring to the drawings, the chip screen 5 includes a drum 6 having trunnions 7, each located on the outer surface of the drum. Each of the trunnions 7 run on a pair of rollers 8 supported on the pedestals 9. The drum 6 is rotated at relatively low speed by means of a chain drive or similar type of drive, not shown, in well known manner.

The drum 6 is here shown as being in two sections 10 and 11. However, it is to be understood that the drum may be made up of more than two sections, depending on the volume of chips to be processed in a given time and the degree of grading and separation of the wood chips required.

The section 10 of the drum at the inlet end A is perforated as indicated at 12, while the section of the drum 11 at the discharge end B is perforated as indicated at 13. The perforations 12 are smaller in size than the perforations 13 and they may be round or in the form of slots, or a combination of both. The perforations 12 and 13 may each be all of the same size or may be in patterns of small and large holes, for instance, the pattern may consists of a large hole surrounded by a number of smaller holes.

A casing 14 extends the full length of the drum 6 in spaced radial relation thereto. The casing 14 surrounds the upper half of the drum and extends downwards for a portion only of the lower half of the drum. This casing 14 is closed only at the discharge end B of the drum 6 by the end wall 15, located relatively close to the end of the drum.

Mounted adjacent to the inlet end A of the drum 6 is a chute 16 by means of which the raw chip material is directed into the interior of the drum, preferably at a point immediately above the central axis of the drum. Similarly, a discharge chute 17 including an enclosed spiral conveyor 18 is mounted at the discharge end B of the drum adjacent to the lower periphery thereof and below the lower edge 15*a* of the end wall 15 of the casing 14. This chute 17 and conveyor 18 carry off oversize chips which cannot pass through the perforations 12 and 13 of the drum 6 for further processing.

An exhaust fan 19 and a cyclone separator 20 are mounted adjacent to the upper portion of the discharge end B of the drum 6 and a conduit 21 connects the fan 19 with an opening in the end wall 15 of the casing 14 and with the upper interior area of the drum 6.

The drum 6 is provided with peripheral inwardly projecting end flanges 22. Between these end flanges 22, a spiral baffle 23 extends the full length of the drum and is secured to the inner surface of the drum to rotate therewith. The baffle 23 has a radial depth D and its inner peripheral edge is indicated at 24. The ends of the baffle 23 is preferably curved as indicated at 25.

A series of circumferentially spaced apart chip lifters 26 extend longitudinally along the inner surface of the drum 6 and between the flights 27 of the baffle 23. These chip lifters 26 have a radial depth approximately equal to the radial depth of the end flanges 22 of the drum 6.

The fine wood chips which can pass through the perforations 12 of the drum 6 fall onto a conveyor 28 located under the drum 6, while the acceptable wood chips which can pass through the perforations 13 fall onto a conveyor 29.

In the operation of this invention, wood chips are delivered to the chute 16 and are projected into the interior of the drum 6, preferably at or near the central axis of the drum. The chips are picked up by the lifters 26 and tossed about in the interior of the drum 6 and are picked up by the spiral baffle 23 which moves the chips axially along the drum towards the discharge end B. During this part of the operation, all unwanted material, such as bark and dirt, is separated from the wood chips and is drawn out of the drum 6 and through the duct 21 by air suction created by the fan 19 and is delivered to the cyclone separator 20.

As the wood chips, cleaned of unwanted material, pass along inside the drum, the finer chips and sand, etc. pass through the perforations 12 in the inlet half of the drum and fall onto the conveyor 28 for removal, separating and processing. At this stage, lighter material separated from the wood chips by the combined action of the spiral baffle 23 and the lifters 26 will be floated into the air stream areated by the fan 19 and carried through the drum 6 to be exhausted into the cyclone separator 20. The acceptable wood chips continued along the interior of the drum by the action of the spiral baffle 23 and those of acceptable size pass through the perforations 13 in the section 11 of the drum and fall onto the conveyor 29 for removal and processing. Any lighter material still clinging to the wood chips will be separated and floated into the air stream and be exhausted into the cyclone separator 20.

Wood chips which are too large to pass through either of the perforations 12 and 13 and which have been cleaned of all unacceptable material continue through the drum 6 to the discharge chute 17 and the spiral conveyor 18 and are carried off from there for further shredding or processing. Where the volume and weight of the unwanted material, floated in the interior of the screen by the combined action of the spiral conveyor 23 and the chip lifters 26 and withdrawn from the interior of the screen by the induced draft effected by the fan 19, requires a very high capacity fan, an air lock (not shown) may be installed at the inlet end of the screen and/or at the discharge end of the screen.

The combination of the spiral baffle 23 and the wood chip lifters 26 ensure that the wood chips will be tumbled sufficiently to clean them of all unwanted matter, leaving only clean wood chips which are passed through the perforations 13 and those which are too large are discharged through the conveyor 18. Sand and other dense material attached to the material delivered to the screen by the chute 16 will fall by gravity and pass through the perforations 12 along with fines to the conveyor 28 below. The fact that the unwanted matter is tossed free of the wood chips over the whole length of the drum ensures that this matter will be readily picked up by the air suction created by the fan 19 and be removed from the drum, leaving only clean wood chips to be graded and separated.

While the invention is illustrated as having two sections 10 and 11 to the screen, more than two sections may be used with each section of the screen having perforations of a size to permit the passage therethrough of different sized chips and fines.

The embodiments of the invention in which an exclusive property or privilege is claimed are defined as follows:

1. A wood chip screen of the rotary type comprising a screen having perforations in a first inlet portion thereof to permit passage therethrough of fines material and having perforations in a second discharge portion thereof to permit pasage therethrough of acceptable chips, a hollow spiral baffle secured to the inner surface of the screen, means to separate unwanted material from the wood chips and to float said unwanted material into the interior of the screen, air suction means creating an air stream to withdraw from the interior of the screen the said unwanted material, said air suction means including a conduit communicating with the interior of the screen at an end thereof such that the unwanted material can pass with said air stream directly from the interior of the screen into said conduit without passing through the screen perforations, and including a fan means for drawing air from the interior of the screen into said conduit, a cyclone separator in communication with the fan, first conveyor means below the said screen to receive the fines and acceptable chips, and second conveyor means adjacent the discharge end of the screen to receive oversize wood chips, and a casing enclosing the upper half and a portion only of the lower half of the screen in spaced relation thereto, the said casing including an end closure plate adjacent to the discharge end of the screen, said conduit connecting the said fan with the interior of the screen through the said casing and closure plate.

2. A wood chip screen as set forth in claim 1 in which the perforations in the inlet portion of the screen are smaller in size than the perforations in the discharge portion of the screen, and the said first mentioned conveyor means include a pair of conveyors, one located under the inlet portion of the screen and the other located under the discharge portion of the screen.

3. A wood chip screen as set forth in claim 1 in which the said second mentioned conveyor means comprises a spiral conveyor and a conduit extending between one end of the spiral conveyor and the adjacent end of the chip screen below the lower edge of the end plate of the said casing.

4. A wood chip screen as set forth in claim 1 in which the said conduit joins with the said casing end plate on the upper portion of the vertical axis of the screen.

5. A wood chip screen as set forth in claim 1 in which the means to separate the unwanted material from the wood chips include a series of longitudinally disposed chip lifters secured to the inner surface of the screen between the flights of the spiral baffle.

6. A wood chip screen as set forth in claim 5 in which the said chip lifters are equally spaced apart circumferentially about the inner surface of the screen.

7. A wood chip screen as set forth in claim 5 in which the said chip lifters are flat plates extending radially inwards from the periphery of the screen to a depth equal to the radial depth of the end flanges of the screen.

8. A wood chip screen as set forth in claim 1 in which the screen has shallow end flanges extending radially inwards from the periphery of the screen, and the radial depth of the spiral baffle extends inwards from the periphery of the screen to a depth greater than the radial depth of the end flanges of the screen.

9. A wood chip screen as set forth in claim 8 in which the lower edge of the casing end closure plate is located at the lowest level of the inner peripheral edge of the spiral baffle to provide an oversize chip discharge opening between the lower edge of the end closure plate and the adjacent inner peripheral edge of the end flange of the screen.

10. A wood chip screen as set forth in claim 9 in which a conduit connects the said oversize chip discharge opening of the screen with the said second conveyor means.

* * * * *